US005788824A

United States Patent [19]

Catonne et al.

[11] Patent Number: 5,788,824

[45] Date of Patent: Aug. 4, 1998

[54] PROCESS FOR CONDITIONING THE COPPER OR COPPER-ALLOY EXTERNAL SURFACE OF AN ELEMENT OF A MOLD FOR THE CONTINUOUS CASTING OF METALS, OF THE TYPE INCLUDING A NICKEL PLATING STEP AND A NICKEL REMOVAL STEP

[75] Inventors: Jean-Claude Catonne, La Celle St Cloud; Christian Allely, Longevill les Metz; Remy Nicolle, Jussy; Gérard Raisson, Nevers, all of France

[73] Assignees: Usinor Sacilor (Societe Anonyme), Puteaux, France; Thyssen Stahl Aktiengesellschaft, Duisburg, Germany

[21] Appl. No.: 838,847

[22] Filed: Apr. 11, 1997

[30] Foreign Application Priority Data

Apr. 12, 1996 [FR] France ..... 96 04562

[51] Int. Cl.[6] ..... C25D 5/34; C25D 7/04; C25D 5/12; C23C 28/00

[52] U.S. Cl. ..... 205/210; 205/151; 205/181; 205/191; 205/206; 205/207; 205/215; 205/219; 205/271; 205/272; 205/273; 205/274

[58] Field of Search ..... 205/70, 102, 151, 205/181, 206, 207, 210, 215, 219, 271, 272, 273, 274, 191

[56] References Cited

U.S. PATENT DOCUMENTS

| | | | |
|---|---|---|---|
| 4,264,420 | 4/1981 | Tomaszewski | 204/146 |
| 4,502,924 | 3/1985 | Minami et al. | 205/215 |
| 4,554,049 | 11/1985 | Bastenbeck | 156/656 |

FOREIGN PATENT DOCUMENTS 0395542 10/1990 European Pat. Off. .

OTHER PUBLICATIONS

International Search Report Mar. 12, 1996.

Marti et al., "Hardness of Sulfamate Nickel Deposits", Plating, pp. 377–385, Apr. 1969.

*Primary Examiner*—Kathryn L. Gorgos
*Assistant Examiner*—Edna Wong
*Attorney, Agent, or Firm*—Sixbey Friedman Leedom & Ferguson; Thomas W. Cole

[57] ABSTRACT

The subject of the invention is a process for conditioning the copper or copper-alloy external surface of an element of a mold for the continuous casting of metals, of the type including a step of nickel plating of said surface and a step of nickel removal therefrom, wherein:

a preparation of said surface, comprising in succession an operation of cleaning said bare surface, an operation of pickling said bare surface in an oxidizing acid medium and an operation of brightening said bare surface, is carried out;

then, an operation of nickel plating of said bare surface is carried out by electroplating, by placing said element as the cathode in an electrolyte consisting of an aqueous nickel sulfamate solution containing from 60 to 100 g/l of nickel;

then, after said element has been used, an operation of partially or completely removing the nickel from said surface electrolytically is carried out, by placing said element as the anode in an electrolyte consisting of an aqueous nickel sulfamate solution containing from 60 to 100 g/l of nickel and sulfamic acid in an amount from 20 to 80 g/l, and the pH of which is less than or equal to 2;

and then a new nickel plating of said surface is carried out, if appropriate preceded by a preparation of the surface of the bared copper as explained previously.

32 Claims, No Drawings

PROCESS FOR CONDITIONING THE COPPER OR COPPER-ALLOY EXTERNAL SURFACE OF AN ELEMENT OF A MOLD FOR THE CONTINUOUS CASTING OF METALS, OF THE TYPE INCLUDING A NICKEL PLATING STEP AND A NICKEL REMOVAL STEP

FIELD OF THE INVENTION

The invention relates to the continuous casting of metals. More precisely, it relates to the conditioning of the external surface of the copper or copper-alloy elements of the molds in which the solidification of metals such as steel is initiated.

The continuous casting of metals such as steel is carried out in bottomless molds, at the walls which are vigorously cooled by the internal circulation of a coolant such as water. The metal in the liquid state is brought into contact with the external surfaces of these walls and starts to solidify thereon. These walls must be made of a material which is an excellent heat conductor so that they can remove sufficient heat from the metal in a short time. Generally, copper or one of its alloys, containing for example chromium and zirconium, is adopted for this purpose.

The faces of these walls which are intended to be in contact with the liquid metal are coated with a layer of nickel, the initial thickness of which may in general be as high as 1 to 2 mm. It has several functions. On the one hand, it enables the heat transfer coefficient of the walls to be adjusted to an optimum value (this being lower than if the metal were brought directly into contact with the copper) so that the metal solidifies under proper metallurgical conditions: too rapid a solidification would cause defects on the surface of the product. This adjustment is carried out by varying the thickness and the structure of the nickel layer. On the other hand, it forms a protective layer for the copper, protecting it from being excessively stressed thermally and mechanically. This nickel layer wears out in the course of use of the mold. It must therefore be restored periodically by complete removal of the remaining thickness, followed by deposition of a new layer, but such restoration obviously costs much less than complete replacement of worn copper walls.

Deposition of this nickel layer on the walls of the mold is therefore a fundamental step in preparing the casting machine, and it is important to optimize, at the same time, the cost, use properties and adhesion qualities thereof. This is, in particular, the case on machines intended to cast ferrous-metal products, in the form of a strip a few millimeters in thickness, which do not need subsequently to be hot rolled. These machines, the development of which is currently in progress, include a mold consisting of two rolls rotating in opposite directions about their axes, which are maintained horizontal, and of two refractory side plates pressed against the ends of the rolls. These rolls have a diameter which may be as high as 1500 mm and a width which, on the current experimental plants, is approximately 600 to 800 mm. However, long term, this width will have to be as high as 1300 to 1500 mm in order to meet the productivity requirements of an industrial plant. These rolls consist of a steel core around which is fixed a copper or copper-alloy sleeve, the sleeve being cooled by circulating water between the core and the sleeve or, more generally, by circulating water inside the sleeve. It is the external face of this sleeve which must be covered with nickel, and it may easily be imagined that, because of the shape and size of this sleeve, its conditioning is more complex than that of conventional continuous-casting molds which are formed from an assemblage of flat plates, or of tubular elements, and which are of much smaller size. Optimization of the way in which the nickel is deposited is more especially important in the case of sleeves for casting rolls since:

because there is no subsequent hot rolling, the surface defects on the strip, which would result from a mediocre quality of the nickel coating, further run the risk of proving to be inhibitory in respect of the quality of the final product;

as the quantities of nickel to be deposited on the sleeves before they are used, and to be removed at the start of the operation of regeneration of the layer, are relatively large, it is necessary to handle correspondingly large volumes of chemicals, requiring optimization in order to minimize the cost of the operation; the problem also arises of the quantity and toxicity of the liquid and solid non-recyclable byproducts resulting from the various steps in the treatment.

The operation of complete removal of the nickel from the sleeve, which must precede restoration of the nickel layer, is also very important. On the one hand, its proper completion largely determines the quality of the nickel layer which will be subsequently deposited, especially its adhesion to the sleeve. On the other hand, this nickel removal operation must be carried out without consuming a very large amount of the copper of the sleeve, which is an extremely expensive component and the duration of its use must be extended as long as possible. This last requirement, in particular, virtually excludes the use of a purely mechanical method for this nickel removal, since its precision would not be sufficient to guarantee both the complete removal of the nickel and the safeguarding of the copper over the entire surface of the sleeve.

Other casting processes are intended to cast even thinner metal strip by depositing the liquid metal onto the periphery of a single rotating roll, which may also consist of a steel core and a cooled copper sleeve. The problems of conditioning the surface of the sleeve which have just been described are easily transposable thereto.

SUMMARY OF THE INVENTION

The object of the invention is to propose a method, which is economic and causes little pollution, providing optimum quality in the conditioning of the copper or copper-alloy walls of a mold for the continuous casting of metals, by deposition of a nickel layer, and also including a step of periodic regeneration of this layer. This method should be particularly suited to the case of the conditioning of the sleeves of rolls for a twin-roll or single-roll casting machine.

For this purpose, the subject of the invention is a process for conditioning the copper or copper-alloy external surface of an element of a mold for the continuous casting of metals, of the type including a step of nickel plating of said surface and a step of nickel removal therefrom, wherein:

a preparation of said surface, comprising in succession an operation of cleaning said bare surface, an operation of pickling said bare surface in an oxidizing acid medium and an operation of brightening said bare surface, is carried out;

then, an operation of nickel plating said bare surface is carried out by electroplating, by placing said element as the cathode in an electrolyte consisting of an aqueous nickel sulfamate solution containing from 60 to 100 g/l of nickel;

then, after said element has been used, an operation of partially or completely removing the nickel from said surface electrolytically is carried out, by placing said element as the anode in an electrolyte consisting of an aqueous nickel sulfamate solution containing from 60 to 100 g/l of nickel and sulfamic acid in an amount from 20 to 80 g/l, and the pH of which is less than or equal to 2;

and then a new nickel plating of said surface is carried out, if appropriate preceded by a preparation of the surface of the bared copper as explained previously.

As will have been understood, the invention especially consists in carrying out the deposition of nickel, as well as its removal, by electrolytic methods employing, in both cases, a bath containing nickel sulfamate $Ni(NH_2SO_3)_2$. It has turned out that such baths are particularly suited to producing nickel depositions on copper which exhibit good wear properties. In addition, the possibility of regenerating the nickel removal electrolyte, using it also as the nickel plating electrolyte (after having possibly purified it of copper which is dissolved therein) considerably limits the quantity of chemicals discharged by the sleeve-conditioning shop, this being in the direction for substantially reducing the running costs of the plant and the risks of polluting the environment. In addition, the nickel removed from the sleeve is recovered in the metallic state on the nickel cathode in the nickel removal reactor. Said cathode may in turn be recycled in the steelmaking plant.

DESCRIPTION OF THE PREFERRED EMBODIMENTS

The invention will now be described in detail in one of its embodiments, this being applied to the conditioning of a copper or copper-alloy roll sleeve for a machine for continuous casting of steel between two rolls. However, it is clear that the example described may easily be adapted to the cases of other types of molds having copper or copper-alloy walls.

Conventionally, the new sleeve has overall the shape of a hollow cylinder, made of copper or copper alloy, such as a copper-chromium (1%)-zirconium (0.1%) alloy. Its outside diameter is, for example, about 1500 mm and its length is equal to the width of the strip which it is desired to cast, i.e. about 600 to 1500 mm. By way of indication, its thickness may be about 180 mm, but it varies locally depending, in particular, on the method adopted for fixing the sleeve to the core of the roll. The sleeve is penetrated by channels through which a coolant, such as water, is intended to flow while the casting machine is in use.

In order to make it easier to handle the sleeve during the operations which have just been described, it is firstly mounted on an arbor, and it is in this way that it will be transported from one treatment station to another before it is mounted on the core of the roll. The treatment stations in the nickel plating/nickel removal shop each consist of a tank containing a solution suitable for carrying out a given step in the treatment, above which tank it is possible to place said arbor, with its axis horizontal and rotate it about its axis. The lower part of the sleeve is thus dipped into the solution and rotating the arbor/sleeve assembly enables the treatment of the entire sleeve to be carried out (it being understood that the sleeve normally performs several revolutions on itself during the same treatment, at a speed of approximately 10 revolutions/min for example). It may also be useful, in order to avoid contamination or passivation by the ambient atmosphere of the part of the sleeve which has emerged, to provide on these treatment stations a device for spraying this part which has emerged with the treatment solution. For this purpose, it is also possible to envisage inerting the ambient atmosphere by means of an inert gas, such as argon, and/or to install a system for the cathodic protection of the roll. However, although this is possible, provision may be made for these tanks to allow total immersion of the sleeve, thereby making such spraying or inerting unnecessary.

The bared sleeve firstly undergoes, preferably, mechanical preparation by polishing its surface. Next, it undergoes chemical cleaning in an alkaline medium, which has the purpose of ridding the surface of the sleeve of organic matter which may contaminate it. Cleaning is carried out hot, at a temperature of approximately 40° to 70° C. for fifteen minutes, and is followed by rinsing in water. It may be substituted with, or even supplemented by, an electrolytic cleaning step which would provide an even better surface quality.

The next step is an operation of pickling in an oxidizing acid medium, which has the purpose of stripping off the surface oxides, ensuring that only a very minute thickness of the sleeve is dissolved. For this purpose, use is made, for example, of a 100 ml/l aqueous sulfuric acid solution to which is added, before each operation, 50 ml/l of a 30% hydrogen peroxide solution or of a solution of another peroxy compound. It is also possible to use a chromic acid solution, this compound having both acidic and oxidizing properties. This operation of pickling in oxidizing acid medium is most effective when the temperature of the electrolyte is between 40° and 55° C. It is advantageous to maintain this temperature at the interface by circulating hot water inside the channels in the rotating sleeve. The operation lasts approximately 5 minutes and is followed by rinsing in water.

Next, an operation of brightening the surface of the sleeve is carried out, preferably using a 50 g/l sulfamic acid solution for the purpose of avoiding passivation of the surface. This operation takes place at ambient temperature and lasts approximately one minute. The fact of using for this brightening a sulfamic acid solution advantageously avoids contaminating thereafter the nickel-plating bath, of which, as will be seen, nickel sulfamate is the main component.

The total duration of all the operations preparatory to nickel plating which have just been described does not, in principle, exceed 30 minutes. Next, the sleeve is transferred as quickly as possible to the nickel-plating station without undergoing rinsing, so as to profit from the presence on its surface, after brightening, of a sulfamate film which protects it from passivation.

The nickel-plating operation is, preferably but not necessarily, carried out in two steps: a so-called "pre-nickel-plating" step may, in fact, precede the nickel-plating operation proper, during which most of the nickel is deposited. The purpose of this prenickel-plating step is to complete the preparation of the surface before nickel plating so as to obtain as adherent a nickel deposition as possible. This proves particularly useful when the sleeve is not made of pure copper (which is relatively easy to nickel plate) but is made of a copper-chromium-zirconium alloy which is more likely to undergo passivation, which passivation would be detrimental to the adhesion of the nickel. This pre-nickel-plating operation is carried out by placing the sleeve as the cathode in an electrolysis bath consisting of an aqueous solution of nickel sulfamate (50 to 80 g/l) and of sulfamic acid (150 to 200 g/l). The cathode current density is from 4 to 5 $A/dm^2$ and the duration of the operation is from 4 to 5 minutes. One or more soluble anodes (made of nickel) or insoluble anodes (for example made of $Ti/PtO_2$ or $Ti/RuO_2$) may be used. In the case of the use of insoluble anodes, it is preferable to work at a low anode current density, of from 0.5 to 1 A/dm$^2$, in order to limit the sulfamic acid hydrolysis reaction, and therefore the need to regenerate periodically the prenickel-plating bath. It is also conceivable to use as pre-nickel-plating electrolyte the bath known by the name "Wood's bath", which is a mixture of nickel chloride and hydrochloric acid. It makes it possible-to work at a cathode current density of about 10 A/dm$^2$, or even higher. However, the use of a sulfamate-containing pre-nickel-plating electrolyte, having a composition close to that of the nickel-plating and nickel-removal electrolytes, enables the management of the shop to be simplified. This pre-nickel-plating operation makes it possible to deposit on the surface of the sleeve a nickel layer having a thickness of a few gm (for example, from 1 to 2 μm), while at the same time removing the acid deposits which could remain therein.

Next comes the nickel-plating operation proper. This is carried out in an electrolyte essentially based on an aqueous nickel sulfamate solution containing 11% of nickel. The solution contains from 60 to 100 g/l of nickel, which corresponds to approximately 550 to 900 g/l of nickel sulfamate solution. Preferably, the pH of the solution is maintained between 3 and 4.5. Above 4.5, nickel precipitation would be observed, while below 3 the deposition efficiency would decrease. For this purpose, from 30 to 40 g/l of boric acid may be added to the electrolyte. Working in this pH range is, furthermore, favorable to obtaining a nickel deposit having few internal tensile stresses which would threaten its cohesion and its adhesion to the copper substrate. When the soluble anode or anodes consist of pure nickel, for example in the form of balls contained in anode baskets made of titanium, chloride anions must be introduced into the bath, these being indispensable for electrolytic dissolution of pure nickel. Magnesium chloride, $MgCl_2.6H_2O$, in an amount of approximately 6 g/l, is well suited for this purpose. The bath may also contain magnesium sulfate (for example, approximately 6 g/l of $MgSO_4.7H_2O$), which makes it possible to obtain a finer crystallization of the nickel deposit. It is also advisable to add an anti-pitting agent to the bath, such as an anionic surfactant. Alkyl sulfates, such as lauryl sulfate, or alkyl sulfonates are suitable for this purpose. 50 g/l of lauryl sulfate is an appropriate content. A cathode current density of about 3 to 5 A/dm$^2$ is dictated if the operation does not involve the hydrodynamics of the bath. However, if the interior of the electrolyte is stirred, this current density may be increased up to 20 A/dm$^2$, or even higher, thereby improving the renewal of the boundary layer adjacent to the sleeve, and therefore accelerating the rate of deposition. From this point of view, it is also recommended to heat the electrolyte since, in this case, it is possible to work at a higher current density. However, it is preferable not to exceed a temperature of 50° C., since above this temperature the hydrolysis of sulfamate into ammonium sulfate is substantially accelerated, and the quality of the deposit deteriorates—an increase in its hardness and in its internal tensile stresses is observed. Simultaneously, it is recommended to heat the sleeve itself to a temperature close to that of the bath, for example by making hot water circulate through it. Experience shows that by operating in this way it is possible to optimize the in-use properties of the nickel coating and its crystalline structure.

As was stated in the example described (which, from this point of view, is not limiting), the anode or anodes are soluble anodes consisting of one or more titanium anode baskets containing nickel balls. If these balls are pure nickel, it was seen that it was necessary to arrange for chloride anions to be present in the bath in order to allow electrolytic dissolution of the nickel balls. If it is desired to avoid the presence of chlorides, because of their corrosivity, it is possible to use nickel "depolarized" with sulfur or with phosphorus.

The tanks of the plant are made of a plastic which is compatible with sulfamate and, preferably, does not decompose into chlorides, or are made of a metallic material coated with such a plastic. In the latter case, it may be recommended to provide the metallic part with cathodic protection. Likewise, it is preferable that the attached metal frames and other infrastructures, which could be corroded by the vapors emanating from the treatment baths or be the source of stray currents, should also be plastic-coated.

Mention has already been made of the phenomenon of the hydrolysis of sulfamate into ammonium sulfate, according to the reaction:

$$NH_2SO^-_3+H_2O\rightarrow SO^{2-}_4+NH^+_4$$

This reaction leads to a build-up of sulfate in the bath, which, above a concentration of about ten grams per liter, contributes to increasing the internal tensile stresses in the nickel deposit. It is therefore necessary to monitor the sulfate concentration of the electrolyte, and to effect its removal when this is necessary. This is carried out by precipitating a sulfate salt, such as barium sulfate, the solubility of which is particularly low. The barium ions may be introduced by means of an addition of barium oxide or of barium sulfamate. The barium sulfate precipitates may be removed by filtration and the filtered solution is reintroduced into the nickel-plating tank. Advantageously, the operation may be carried out by continuously sampling a fraction of the electrolyte while it is being used, this fraction being injected into a reactor in which the sulfate precipitation is carried out; thereafter, still continuously, said fraction is filtered and reinjected into the nickel-plating tank.

Moreover, the electrolyte tends to be acidified by decomposition of the ammonium:

$$NH^+_4 \leftrightharpoons NH_{31+H}^+$$

This progressive acidification makes it suitable to be recycled as a nickel sulfamate electrolyte for nickel removal, which operation, as will be seen later, must be carried out in a more acid medium than nickel plating.

The internal tensile stresses in the nickel plating may advantageously be minimized if so-called "alternating" electrolysis is employed, this consisting in operating in a succession of working phases lasting a few minutes and of rest phases lasting a few seconds, during which the electrical supply to the electrodes is interrupted.

Unless it is not possible to immerse the sleeve in the electrolyte completely, it is highly recommended to spray the surface of the non-submerged part of the sleeve permanently with this same electrolyte, or to render this same part inert using an inert gas. In this way, the risks of passivation of the freshly nickel-plated surface are avoided, which passivation would be prejudicial to good adhesion and to good cohesion of the coating. For this same reason, spraying the sleeve or inerting its surface while it is being transferred between the pre-nickel-plating station and the nickel-plating station is also recommended. Providing cathodic protection of the sleeve may also be envisaged. This transfer must, in any case, be carried out as quickly as possible.

It is possible to work either at a set voltage or at a set current density. When the electrolysis is carried out at a voltage of about 10 V with a current density of approximately 4 A/dm$^2$, a duration of approximately 5 to 8 days (depending also on the depth of immersion of the sleeve in-the bath) enables a nickel deposit reaching 2 mm in thickness to be obtained. Next, the sleeve is unfastened from its support shaft, and is ready to be joined onto the core in order to form a roll which will be used on the casting machine, after a possible final conditioning of the surface of the nickel layer, such as imprinting a defined roughness using a shot-peening process, a laser machining process or any other process. As is known, such conditioning is aimed at optimizing the conditions of heat transfer between the sleeve and the solidifying metal.

During this use, the nickel layer is subjected to attack and to mechanical wear which result in its progressive disappearance. Between two casting runs, the surface of the sleeve must be cleaned and the nickel layer may, at least from time to time, be lightly machined for the purpose of compensating for any heterogeneities in its wear which could compromise the uniformity in the thermomechanical behavior of the sleeve over its entire surface. It is also important to restore the initial roughness of the sleeve each time this is necessary. When the average thickness of the nickel layer on the sleeve reaches a predetermined value, generally estimated to be approximately 0.5 mm, the use of the roll is interrupted and the sleeve is removed and undergoes a nickel-removal treatment.

This nickel removal may be complete and precede restoration of the nickel layer according to the process which has been described previously. For this purpose, the sleeve is once again mounted on the shaft which supported it during the nickel-plating operations.

Several options are available to the user for accomplishing this nickel removal. Purely chemical nickel removal is conceivable. The reagent used should dissolve the nickel without significantly attacking the copper substrate. For this purpose, a reagent consisting of a mixture of sodium dinitrobenzenesulfonate (50 g/l) and of sulfuric acid (100 g/l) could be employed, which already exists on the market for removing nickel from copper substrates in general. Such an operating mode would have the advantage of being relatively quick: a residual nickel thickness of 0.5 mm could be dissolved in approximately 2 hours. However, the reagent is chemically unstable and must be frequently renewed in order to maintain an advantageous rate of nickel removal. Above all, this reagent is toxic and the effluent from the nickel-removal operation must absolutely necessarily be reprocessed.

In particular, it cannot be recycled in another step in the treatment or in another shop in a steelworks or the like.

The other conceivable way of removing nickel is the electrolytic route, because of the perceptible differences between the standard potentials of copper and nickel (respectively 0.3 V and −0.4 V with respect to the standard hydrogen electrode). It is also applicable for the copper-chromium-zirconium alloys of which the sleeve may be made. In this case, nickel dissolution occurs by placing the sleeve as the anode in an appropriate electrolyte concerning the choice of this electrolyte, it is known (see document FR 2,535,349) for the removal of nickel from copper substrates in general to use an electrolyte essentially consisting of a mixture of sulfuric acid (20–60% by volume) and of phosphoric acid (10–50% by volume). Such an electrolyte has the advantage of causing immediate passivation of the surface of the sleeve when the copper is bared, which guarantees that electrolytic dissolution of the nickel takes place without significant consumption of the copper of the sleeve. However, here too, such a method has the drawback of requiring for its implementation a special solution, which is incompatible with the other operations carried out in the sleeve nickel-plating/nickel-removal shop. In addition, this operation is accompanied by the evolution of hydrogen at the A. cathode, preventing nickel deposition, and by the formation of sludge whose removal adds to the overall cost of the operation. Finally, this electrolyte is very aggressive with respect to the plant's infrastructure, which therefore has to be carefully protected.

The inventors have therefore conceived, for carrying out this step of removing nickel from the sleeve, the use of an electrolyte based on sulfamic acid and nickel sulfamate, therefore a composition similar to that of the nickel-plating and pre-nickel-plating electrolytes. This considerably simplifies the management of the materials in the sleeve-conditioning shop. A nickel-removal bath can be reused as the nickel-plating or pre-nickel-plating bath, after removing any copper which it has dissolved and after making a very small correction to its composition, aiming in particular to compensate for the evaporation of water and to reduce its acidity in order to work in the desired optimum pH range. In addition, when a nickel-plating bath is spent and has to have its composition readjusted, it may be recycled within the very shop in the nickel-removal bath, to which it will be necessary simply to add sulfamic acid, and the nickel content of which will be able to be increased during the nickel-removal operation. The result is that the sleeve nickel-plating/nickel-removal shop does not generate in significant quantity any effluent to be reprocessed externally. This leads to major savings in materials and has an extremely small impact on the environment, even though, with poorly managed flows of materials, such a shop would be likely to pose major pollution risks because of the nature of the products which it uses and of the by-products which it would be likely to generate.

Under these conditions, the composition proposed for the nickel-removal electrolyte is as follows: a solution containing 11% of nickel of nickel sulfamate: 550 to 900 g/l, i.e. 60 to 100 g/l of nickel, nickel chloride: 5 to 20 g/l (in order to make it easier to dissolve the nickel from the sleeve as anode and also to contribute to passivation of the bared copper), sulfamic acid: 20 to 80 g/l (preferably approximately 60 g/l) in order to maintain the pH at a value less than or equal to 2. The presence of boric acid (30 to 40 g/l, as in the nickel-plating bath) is also acceptable. The temperature is preferably maintained between 40° and 70° C., to which maintenance hot water circulating in the sleeve may also advantageously contribute. The anode current density is generally from 1 to 20 A/dm$^2$, depending on whether the bath is stirred or not. It is possible, as required, either to work by setting a defined potential difference between the sleeve as anode and a reference electrode or to work at a set current density. However, it is preferable to work at a set potential since, under these conditions, the end of nickel dissolution is manifested in an obvious manner by a significant drop in the current density. With a set current density, the end of nickel dissolution would be more difficult to detect, and the risk of dissolving copper from the sleeve to a significant depth would be greater. The value of the set potential must be chosen depending on the position of the reference electrode in the bath and on the desired rate of dissolution. The duration of the operation also depends on the ratio between the strength of the current and the volume of electrolyte used. By way of indication, a current density of 7 to 8 A/dm$^2$ may correspond to a nickel dissolution rate of approximately 150 μm/h, which is substantially higher than in a highly acid bath of the type of those mentioned previously. For example, a 50% sulfuric acid/50% phosphoric acid bath, under the same conditions, gives a nickel dissolution rate of approximately 50 μm/h. The value of the potential set at the anode is therefore adjusted until the desired current density is obtained. When the measured value of the current density falls significantly, this means that the nickel has been completely dissolved and the copper of the sleeve has begun to be attacked (a current density of 2 A/dm corresponds to copper dissolution at approximately 25 μm/h). It is therefore necessary to stop the electrolysis in order to avoid too significant a dissolution of the sleeve. Under the conditions mentioned, dissolution of a 0.5 mm residual nickel layer takes approximately 3 hours, which is short, and it may be conceivable to tolerate lower dissolution rates which would make it possible to use lower capacity electrolyte baths. Another means of shortening the nickel-removal operation would consist in preceding it by a mechanical nickel-removal operation which would aim to decrease its residual thickness without however reaching the copper. This operation would also have the advantage of making this thickness uniform and of removing the various surface impurities (especially metallic residues) which could locally slow down the onset of dissolution. This would thus avoid a situation in which nickel is still being dissolved in certain regions of the sleeve when in other regions the copper would have already been bared.

In addition, nickel removal in a nickel sulfamate bath advantageously makes it possible to recover, on the cathode, nickel which may be utilized, while at the same time working at a constant nickel concentration in the electrolyte. The nickel thus recovered may be used in particular in the meltshop as an addition element to the liquid steel. In the case of electrolytic nickel removal in a strong acid medium, such as that mentioned previously, nickel recovery should be carried out by treating the residual sludge, which would be much more expensive and complex. The sulfamate bath is also much less aggressive in respect of the plant's infrastructure than it would be with a strong-acid bath.

Depending on the quantity of copper coming from the sleeve, or indeed from the electrical connection elements of the apparatus, and getting into the nickel-removal bath, it may, as stated, be necessary to remove this copper periodically so as to decontaminate the bath. The aim is thus not to contaminate the nickel deposit on the sleeve and to achieve better utilization of the nickel deposited on the cathode. The copper may be removed in various known ways, chemically or electrolytically, discontinuously or continuously.

A variant of the invention consists in carrying out only partial nickel removal from the sleeve. For this purpose, preferably after an operation of mechanically removing part of the nickel layer by machining and grinding, a small thickness of the latter, for example 10 to 20 μm, is electrolytically dissolved in an electrolyte of the type described previously. The work-hardened part of the surface of the sleeve is thus removed and a depassivated surface is also obtained. Next, without rinsing it, the sleeve is transferred into the nickel-plating reactor as quickly as possible in order to avoid passivation of its surface. Next, the desired thickness of nickel is restored by electrolytic nickel plating. In the case in which it is desired that the nickel-plating electrolyte be free of chlorides, the content of chloride ions in the electrolyte is preferably limited to approximately 1 g/l. This content constitutes a compromise between the need not to contaminate the nickel-plating electrolyte too much, which contamination becomes inevitable since the sleeve from which the nickel has been partially removed is not rinsed, and the desire to obtain an industrially appropriate nickel-dissolution rate. By way of indication, when a nickel-removal bath, containing from 60 to 75 g/l of nickel sulfamate, from 30 to 40 g/l of boric acid, 60 g/l of sulfamic acid and 1 g/l of chloride ions provided by nickel chloride, is used at 45° C., an electrolysis duration of 190 minutes is necessary in order to remove 15 gm of nickel from a sleeve immersed up to one third of its height and subjected to a current density of 1 A/dm$^3$. For a current density of 5 A/dm$^3$, this duration is 38 minutes. Since by operating in this manner the nickel-plating operation is very substantially shortened and all the operations of preparation of the copper surface of the sleeve are eliminated, the duration of the reconditioning of the surface of a worn-out sleeve is considerably reduced compared to the operating method previously described.

The invention is particularly applicable to the conditioning of the sleeves of rolls in plants for the twin-roll or single-roll continuous casting of steel. However, it goes without saying that its transposition to treatments of casting molds having copper or copper-alloy walls, of any shape and size, is conceivable.

We claim:

1. A process for conditioning a copper or copper-alloy external surface of an element of a mold for a continuous casting of metals, comprising the steps of:

preparing said surface, including in succession cleaning said surface until said surface is bare copper and pickling said bare surface in an oxidizing acid medium and brightening said bare surface;

electroplating nickel a first time onto said bare surface by placing said element as a cathode in an electrolyte consisting of an aqueous nickel sulfamate solution containing from 60 to 100 g/l of nickel;

partially or completely removing electroplated nickel from said surface electrolytically by placing said element as an anode in an electrolyte consisting of an aqueous nickel sulfamate solution containing from 60 to 100 g/l of nickel and sulfamic acid in an amount from 20 to 80 g/l, and having a pH of which is less than or equal to 2; and nickel electroplating said surface a second time optionally preceded by the surface preparing step.

2. The process as claimed in claim 1, wherein the nickel electroplating electrolyte is maintained at a pH of between 3 and 4.5.

3. The process as claimed in claim 1, wherein the nickel electroplating electrolyte also contains from 30 to 40 g/l of boric acid.

4. The process as claimed in claim 1, wherein one of said two nickel electroplating steps is carried out by using at least one soluble anode made of pure nickel and said nickel sulfamate electrolyte contains chloride ions.

5. The process as claimed in claim 1, wherein the nickel electroplating electrolyte contains magnesium sulphate.

6. The process as claimed in claim 1, wherein the nickel electroplating electrolyte also contains an anti-pitting agent.

7. The process as claimed in claim 6, wherein said anti-pitting agent is an anionic surfactant.

8. The process as claimed in claim 1, wherein said first nickel-plating step is conducted with a cathode current density of between 3 and 20 A/dm$^2$.

9. The process as claimed in claim 1, wherein the nickel electroplating electrolyte is heated.

10. The process as claimed in claim 9, wherein said mold element is also heated to a temperature close to that of the nickel electroplating electrolyte.

11. The process as claimed in claim 1, wherein sulphates formed within the nickel electroplating electrolyte are removed, periodically or continuously.

12. The process as claimed in claim 1, wherein during said first nickel-plating step there occurs a succession of working phases lasting a few minutes and rest phases lasting a few seconds.

13. The process as claimed in claim 1, wherein said first nickel-plating step is preceded by an electrolytic pre-nickel-plating step intended to deposit a nickel layer of a few microns in thickness on the mold element placed as the cathode.

14. The process as claimed in claim 13, wherein said prenickel-plating step is carried out in an electrolyte consisting of an aqueous solution based on nickel sulfamate and sulfamic acid.

15. The process as claimed in claim 14, wherein said prenickel-plating step is carried out at a cathode current density of from 4 to 5 $A/dm^2$.

16. The process as claimed in claim 13, wherein said prenickel-plating step is carried out in an electrolyte based on nickel chloride and hydrochloric acid, called a "Wood's bath".

17. The process as claimed in claim 1, wherein the cleaning step is preceded by a step of polishing the surface of the mold element.

18. The process as claimed in claim 1, wherein the cleaning step is implemented by either an alkaline medium or an electrolytic cleaning operation.

19. The process as claimed in claim 1, wherein the pickling step is carried out in an aqueous solution of sulfuric acid and hydrogen peroxide.

20. The process as claimed in claim 1, wherein the pickling step is carried out in a chromic acid solution.

21. The process as claimed in claim 1, wherein the brightening step is carried out in a sulfamic acid solution.

22. The process as claimed in claim 1, wherein the electrolyte used to remove the electroplated nickel contains at least 1 g/l of chloride ions.

23. The process as claimed in claim 22, wherein the electrolyte used to remove the electroplated nickel contains at least 1 g/l of chloride ions.

24. The process as claimed in claim 1, wherein the nickel-removal electrolyte contains from 30 to 40 g/l of boric acid.

25. The process as claimed in claim 1, wherein the nickel-removal step is carried out at an anode current density of from 1 to 20 $A/dm^2$.

26. The process as claimed in claim 1, wherein the nickel-removal step is carried out at a set potential.

27. The process as claimed in claim 1, wherein the nickel-removal step is preceded by a mechanical operation of partially removing a residual nickel layer.

28. The process as claimed in claim 1, wherein copper contained in the electrolyte used to remove electroplated nickel is removed discontinuously or continuously.

29. The process as claimed in claim 1, wherein the mold element is a sleeve of a twin-roll or single-roll continuous casting roll.

30. The process as claimed in claim 29, wherein, during at least some of said steps, said sleeve is mounted on an arbor placed in a horizontal position above a tank containing a treatment solution to immerse a portion of said sleeve in said solution, and wherein said arbor is rotated during said steps.

31. The process as claimed in claim 30, wherein a non-immersed part of said sleeve is sprayed with said treatment solution.

32. The process as claimed in claim 30, wherein an atmosphere surrounding a non-immersed part of said sleeve is inerted using an inert gas.

* * * * *